US009211441B1

(12) United States Patent
Lawrence

(10) Patent No.: US 9,211,441 B1
(45) Date of Patent: Dec. 15, 2015

(54) INFLATABLE SWIM FIN APPARATUS

(71) Applicant: Charles H. Lawrence, Kapaa, HI (US)

(72) Inventor: Charles H. Lawrence, Kapaa, HI (US)

( * ) Notice: Subject to any disclaimer, the term of this patent is extended or adjusted under 35 U.S.C. 154(b) by 0 days.

(21) Appl. No.: 14/310,537

(22) Filed: Jun. 20, 2014

(51) Int. Cl.
*A63B 31/11* (2006.01)

(52) U.S. Cl.
CPC ..... *A63B 31/11* (2013.01)

(58) Field of Classification Search
CPC ..... A63B 31/11; A63B 2031/112
USPC ..... 441/64, 61
See application file for complete search history.

(56) References Cited

U.S. PATENT DOCUMENTS 3,015,829 A 1/1962 Gronkowski
3,112,503 A * 12/1963 Girden ..... 441/64
3,405,413 A 10/1968 Manis
3,908,213 A * 9/1975 Hill ..... 441/64
4,250,584 A * 2/1981 Korn ..... 441/61
5,259,798 A * 11/1993 Runckel ..... 441/64
5,266,062 A * 11/1993 Runckel ..... 441/64
5,290,194 A * 3/1994 Sneddon et al. ..... 441/64
5,356,323 A * 10/1994 Evans ..... 441/64
6,155,899 A 12/2000 Boddy
6,413,133 B1 * 7/2002 McCarthy ..... 441/64
6,482,058 B2 11/2002 Sanso et al.
6,685,521 B1 * 2/2004 Melius ..... 441/56
6,843,693 B2 * 1/2005 McCarthy ..... 441/64
6,979,241 B2 * 12/2005 Hull ..... 441/64
8,591,274 B2 11/2013 Haller et al.
2005/0245148 A1 * 11/2005 Mun ..... 441/64
2011/0217890 A1 9/2011 Fleck
2013/0090028 A1 * 4/2013 Mayer ..... 441/64

* cited by examiner

*Primary Examiner* — Lars A Olson
*Assistant Examiner* — Jovon Hayes
(74) *Attorney, Agent, or Firm* — Dale J. Ream

(57) ABSTRACT

An inflatable swim fin apparatus includes a foot portion having a lower wall with a peripheral edge and having an upper wall extending upwardly from the peripheral edge of the lower wall, the lower wall and the upper wall defining a foot pocket and a rear opening allowing a user's foot to be received into the foot pocket. The swim fin apparatus includes a fin blade portion coupled to the upper wall of the foot portion, the fin blade portion including a bladder defining an interior space configured to hold a volume of air.

18 Claims, 8 Drawing Sheets

INFLATABLE SWIM FIN APPARATUS

BACKGROUND OF THE INVENTION

This invention relates general to swim fins and, more particularly, to a swim fin having an inflatable bladder and that is foldable for storage when deflated.

Swim fins are aquatic devices worn on the feat or legs of a user that aid the user when moving in water. Specifically, swim fins have a blade or panel that is longer than a human foot and designed to impart more thrust or propulsion when swimming. Swim fins usually have an area for receiving a foot and may include a heel strap to prevent the device from inadvertently becoming dislodged. In addition, swim fins have a blade portion that increases in both length and width as it extends away from the foot receiving portion. In addition, aquatic floatation devices are often used to increase the buoyancy of a swimmer or to enhance the safety of a toddler or disabled person in the water. Floatation devices are often inflatable either by the user's own breath or by an air compressor.

Various devices are known in the art for enhancing the thrust or propulsion of a user in water, such as traditional swim fin devices. Other devices are known for increasing the buoyancy of a person in water, such as life jackets and swim floats. Although assumably effective for their intended purposes, the existing devices do not provide a device for wear on a user's foot that enhances both propulsion and provides buoyancy.

Therefore, it would be desirable to have an inflatable swim fin apparatus that provides enhanced thrust and propulsion as well as providing buoyancy when inflated. Further, it would be desirable to have an inflatable swim fin apparatus that can be selectively inflated or deflated by a user. In addition, it would be desirable to have an inflatable swim fin apparatus that is foldable for storage when deflated.

SUMMARY OF THE INVENTION

An inflatable swim fin apparatus according to the present invention includes a foot portion including a lower wall having a peripheral edge and including an upper wall extending upwardly from the peripheral edge of the lower wall, the lower wall and the upper wall defining a foot pocket and a rear opening allowing a user's foot to be received into the foot pocket. The swim fin apparatus includes a fin blade portion coupled to the upper wall of the foot portion, the fin blade portion including a bladder defining an interior space configured to hold a volume of air.

Therefore, a general object of this invention is to provide a swim fin apparatus that enhances thrust and propulsion to a person when swimming.

Another object of this invention is to provide a swim fin apparatus, as aforesaid, having a bladder that may be selectively inflated.

Still another object of this invention is to provide a swim fin apparatus, as aforesaid, that enhances the buoyancy of a user when swimming.

Yet another object of this invention is to provide a swim fin apparatus, as aforesaid, that is foldable for storage or transport when the bladder is deflated.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

An inflatable swim fin apparatus according to a preferred embodiment of the present invention will now be described with reference to FIGS. 1 to 8 of the accompanying drawings. The swim fin apparatus 10 includes a foot portion 20 configured to receive a person's foot and a fin blade portion 40 having an inflatable bladder 42 and that is foldable when deflated.

Figure 2A:
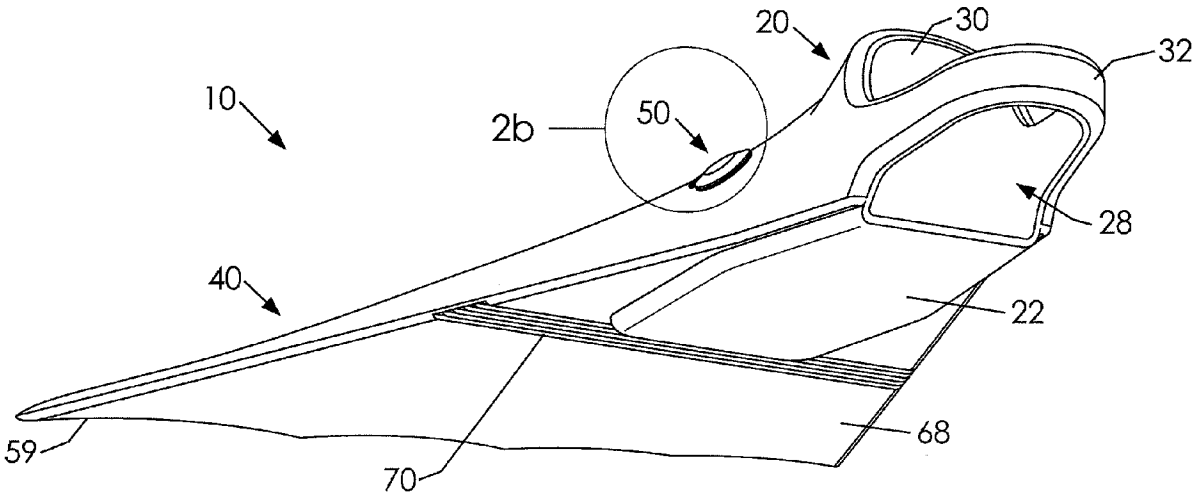
FIG. 2*a* is a perspective view from a lower angle of the swim fin apparatus as in FIG. 1.
Figure 2D:
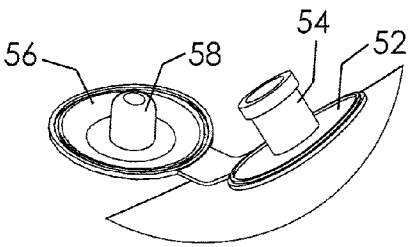
FIG. 2*d* is an isolated view as in FIG. 2*c* illustrating the inflation valve in an open configuration and with the fill port in an extended configuration.

The foot portion 20 of the inflatable fin apparatus 10 includes a lower wall 22 having a peripheral edge. An upper wall 26 extends upwardly from the peripheral edge of the lower wall 22. It is understood that the upper wall 26 may include side and top sections and be configured in the manner of a shoe. Together the lower wall 22 and upper wall 26 define a foot pocket 28 that defines an interior area suitable for receiving a person's foot therein. The walls 22, 26 also combine to define a rear opening 30 dimensioned to allow a person's foot to be received into the interior area of the foot pocket 28 (FIG. 2*a*).

In one embodiment, a heel strap 32 may be coupled to upper wall 26 of the foot portion 20 and extend across the rear opening 30 and be configured to encircle the heel of a person who has positioned his foot in the foot pocket 28.

Figure 4A:
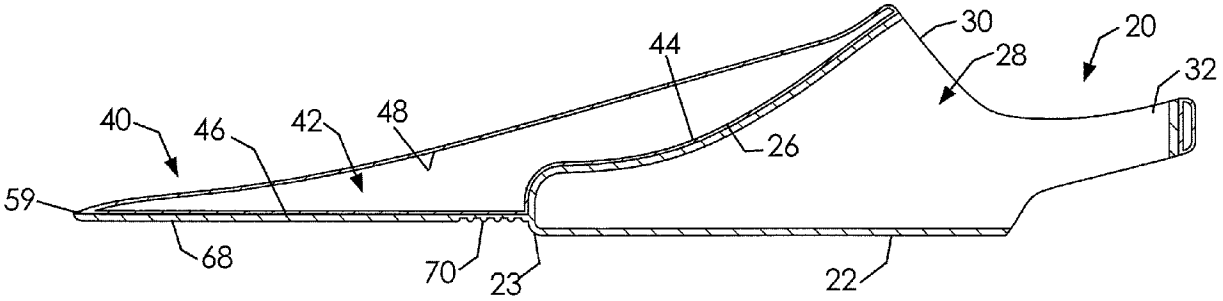
FIG. 4*a* is a sectional view taken along line 4*a*-4*a* of FIG. 3*a* showing the bladder in a partially deflated configuration.
Figure 4B:
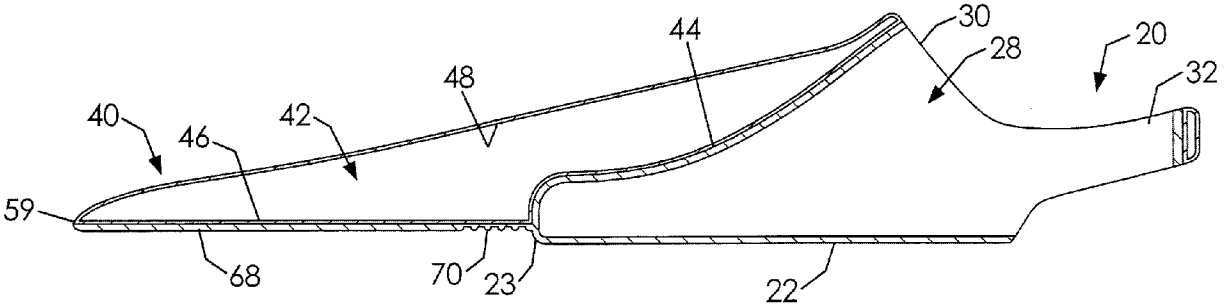
FIG. 4*b* is a sectional view taken along line 4*b*-4*b* of FIG. 3*b* showing the bladder in an inflated configuration.
Figure 5A:
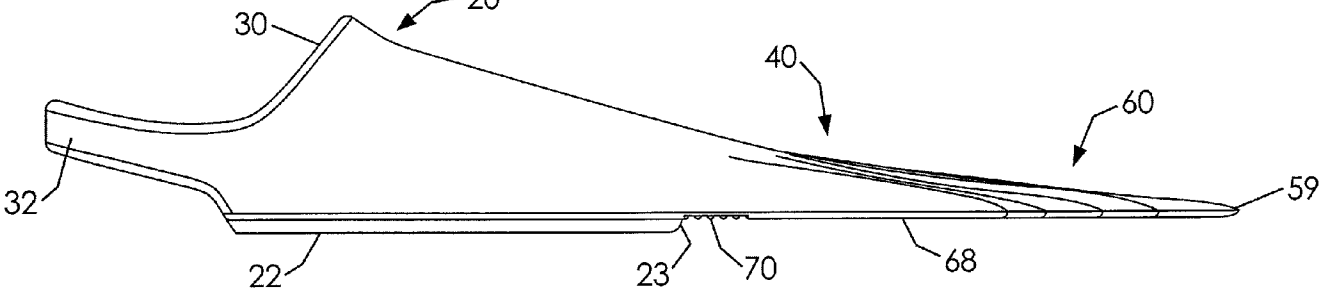
FIG. 5*a* is a side view of the swim fin apparatus as in FIG. 3*a;*
Figure 5B:
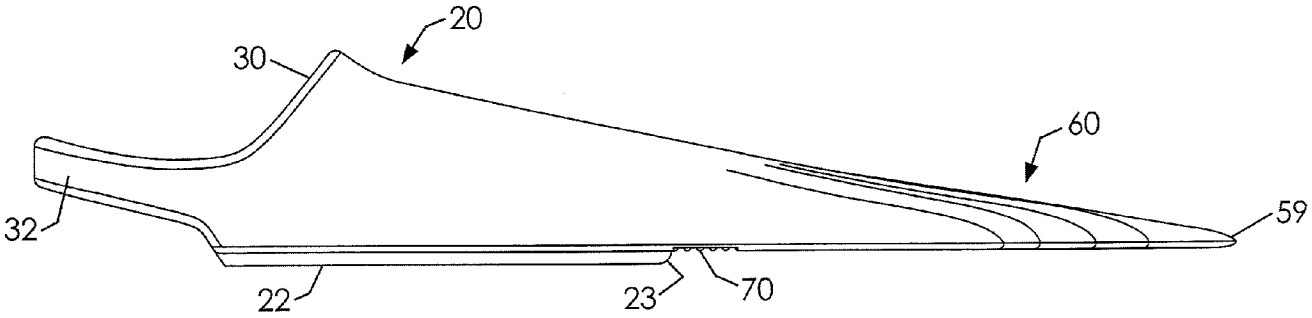
FIG. 5*b* is a side view of the swim fin apparatus as in FIG. 3*b;*
Figure 6:
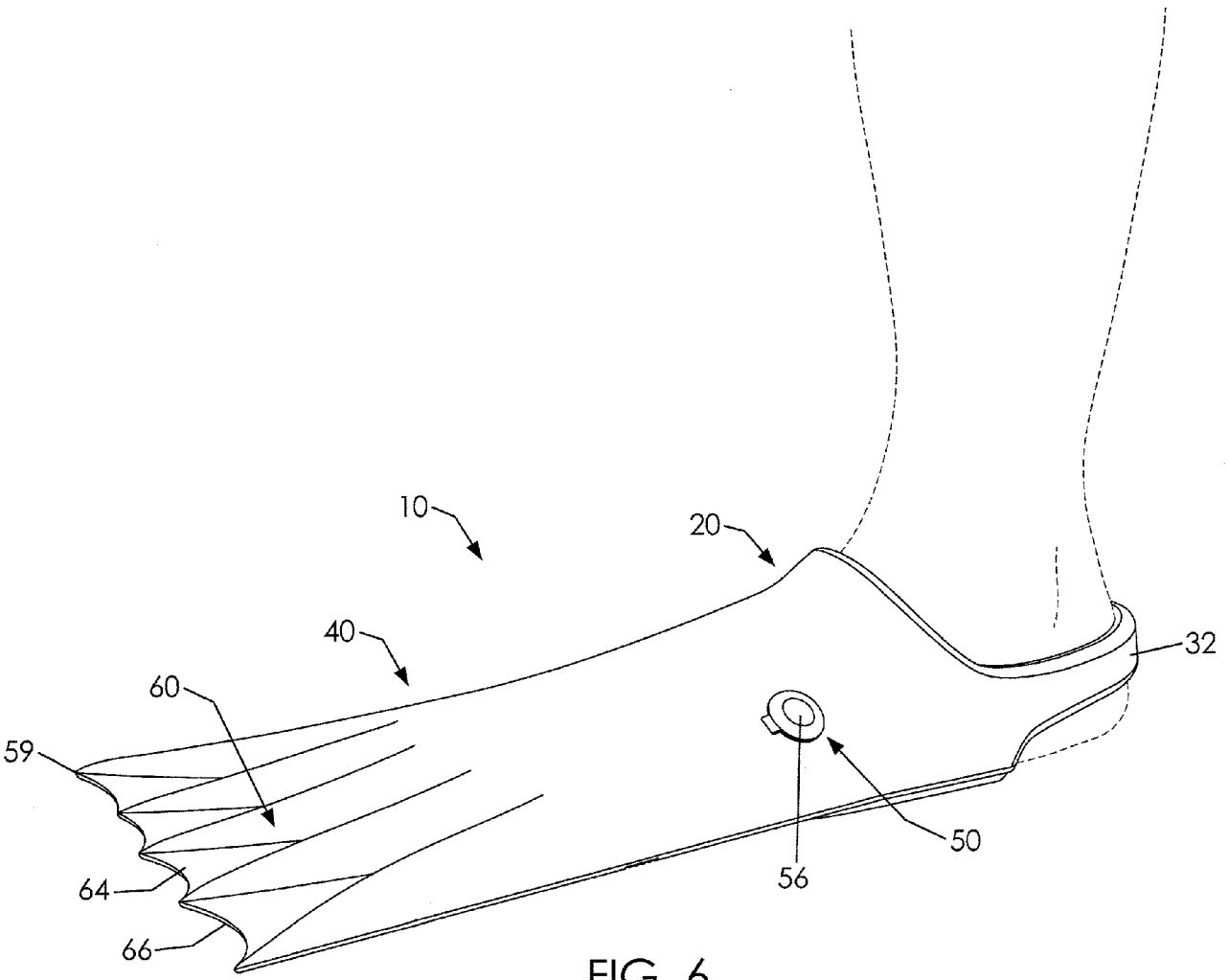
FIG. 6 is a perspective view of the swim fin apparatus as in FIG. 1 in use on a user's foot.

The fin blade portion 40 of the inflatable swim fin apparatus 10 is coupled to the upper wall 26 of the foot portion 20 and includes an air bladder 42. More particularly, the bladder 42 includes a rear wall 44, a bottom wall 46, and a top wall 48 that are integrally connected and configured to define an interior space. The bladder 42 is constructed of a generally flexible material that is airtight so as to hold a volume of air as will be described in more detail below. The rear wall 44 of the bladder 42 is coupled to the upper wall 26 of the foot portion 20 such that the bladder 42 is situated forwardly of the foot portion 20 (FIG. 4*a*).

The bladder 42 is flexible so as to expand when a greater volume is inserted therein and to deflate when air is released therefrom. More particularly, an inflation valve 50 is positioned on the top wall 48 of the bladder 42 and is in communication with the interior space defined by the bladder 42 (FIG. 2). The inflation valve 50 includes a base 52 coupled to an outer surface of the top wall 48 of the bladder 42. A fill port 54 is operatively coupled to the base 52 and is movable between a retracted configuration (FIG. 2*c*) that does not allow air to be transferred to or from the interior space of the bladder 42 and an extended configuration (FIG. 2*d*) that allows air flow to or from the interior space of the bladder 42. The fill port 54 has a tubular configuration through which air may flow. For instance, a user may blow air into the bladder 42 when the fill port 54 is at the extended configuration but not when it is retracted. It is understood that a user may manually move the port between configurations with his fingers.

Figure 2C:
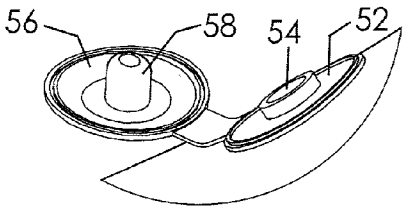
FIG. 2*c* is an isolated view as in FIG. 2*b* illustrating the inflation valve in an open configuration and a fill port in a retracted configuration.
Figure 2B:
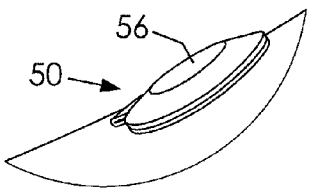
FIG. 2*b* is an isolated view on an enlarged scale taken from FIG. 1, illustrating an inflation valve in a closed configuration.
Figure 3B:
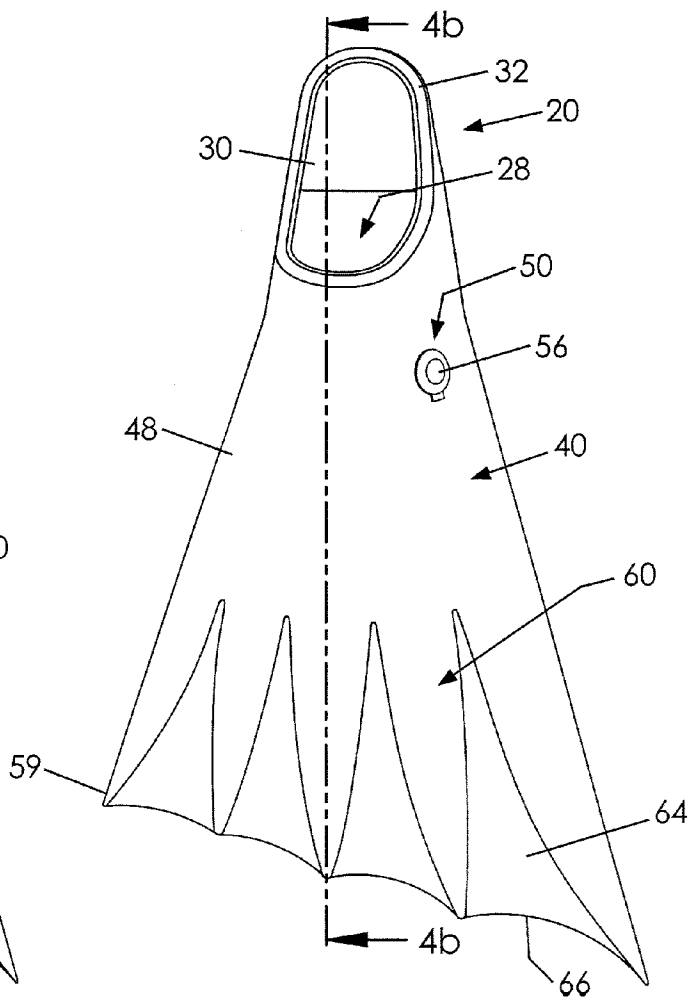
FIGS. 3*a* and 3*b* are top views of the swim fin apparatus as in FIG. 1.
Figure 3A:
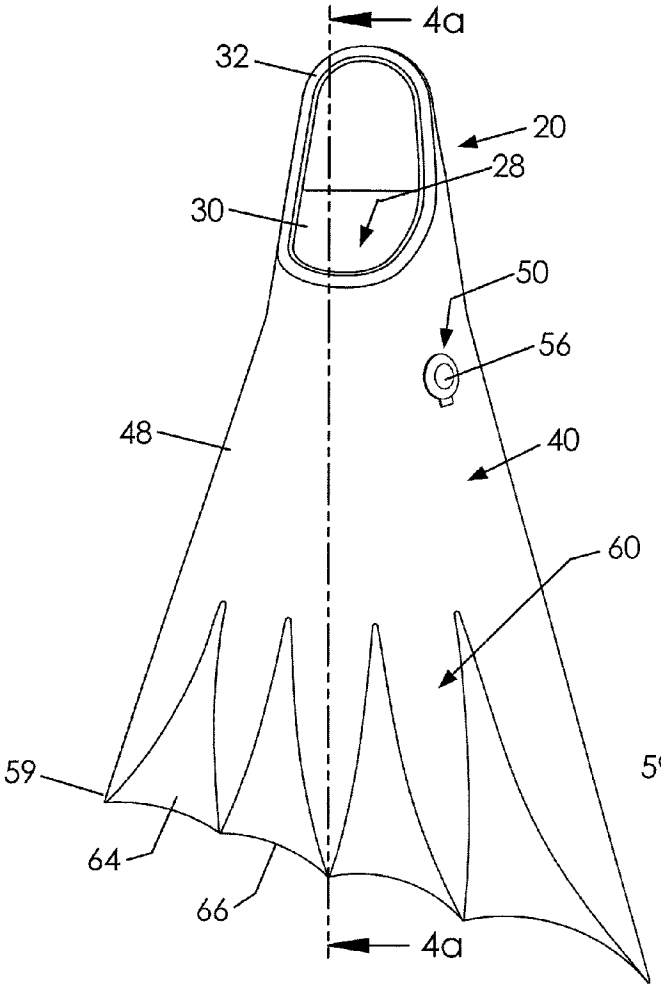

In addition, the inflation valve 50 may include a cap 56 pivotally coupled to the base 52, such as with a tether, and is movable between a closed configuration preventing access to the fill port 54 (FIG. 2*b*) and an open configuration allowing access to the fill port 54 (FIG. 2*c*). A plug 58 may be attached to an inside of the cap 56 and configured to be selectively received by the tubular fill port 54 when the cap 56 is at the closed configuration and to be displaced from the fill port 54 when the cap 56 is at the open configuration (FIG. 2*c*).

The bladder 42 expands as air is inserted through the fill port 54 of the inflation valve 50. The expansion of the bladder 42 can be seen by comparing FIG. 4*a* (partially inflated bladder) and FIG. 4*b* (fully inflated bladder).

Figure 1:
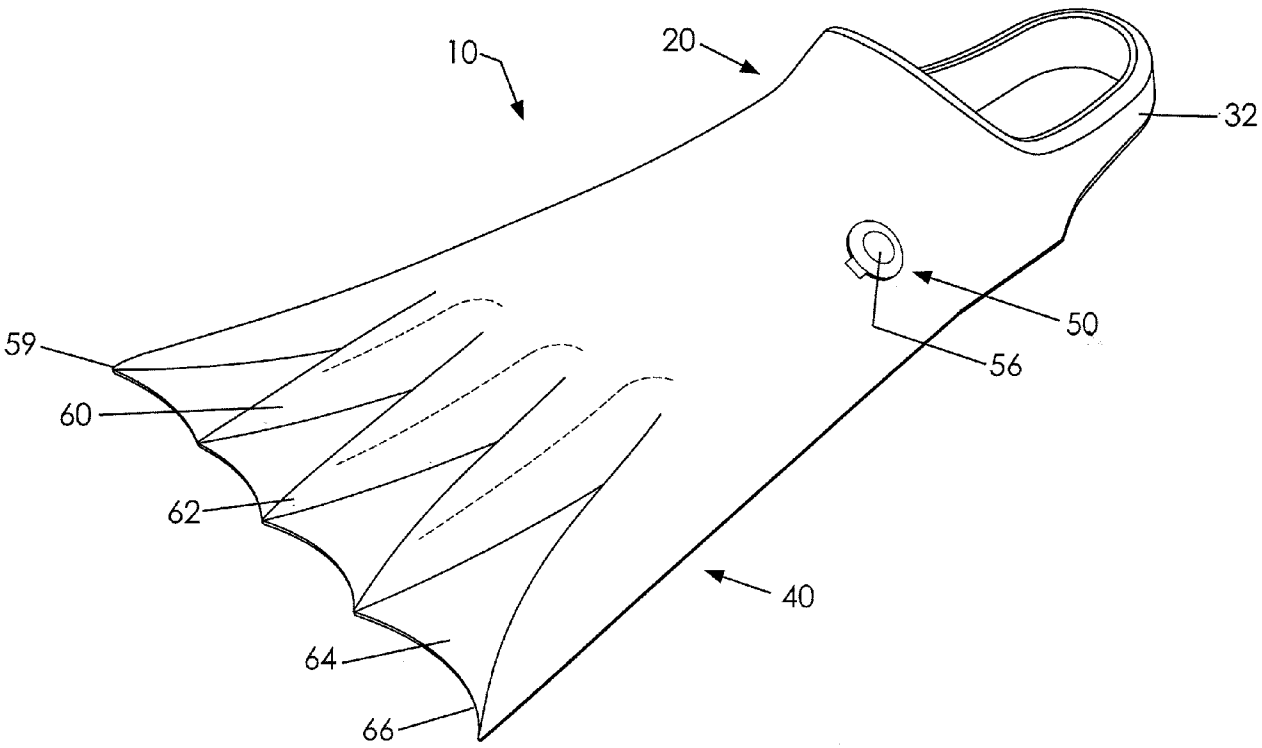
FIG. 1 is a perspective view of an inflatable swim fin apparatus according to a preferred embodiment of the present invention.

The fin blade portion 40 includes a plurality of fin blades 60 positioned adjacent a distal end 59 thereof (FIG. 1). Each fin blade 60 includes a pointed configuration, each having an apex 62 situated adjacent the distal end 59. The fin blade portion 40 includes a plurality of web members 64, each web member 64 extending between adjacent fin blades 60. As shown in FIG. 1, each web member 64 includes a configuration opposite that of a fin blade 60. For instance, as two adjacent fin blades 60 have edges tapering inwardly toward respective apexes at said distal end 59, the web member 64 therebetween has a width that increases toward said distal end 59. Each web member 64 includes a distal edge 66 having a concave configuration. The plurality of fin blades 60 and plurality of web members 64 is constructed of a non-permeable material.

The fin blade portion 40 of the swim fin apparatus 10 includes a sole member 68 having a line of weakness 70 extending between side edges of the fin blade portion 40 and adjacent the front end 23 of the lower wall 22 of the foot portion 20. The line of weakness 70 defines an imaginary axis about which the sole member 68 of the fin blade portion 40 and the lower wall 22 of the foot portion 20 may fold. Accordingly, the swim fin apparatus 10 is movable between a folded configuration (FIG. 8) and an extended configuration (FIG. 1).

Figure 7A:
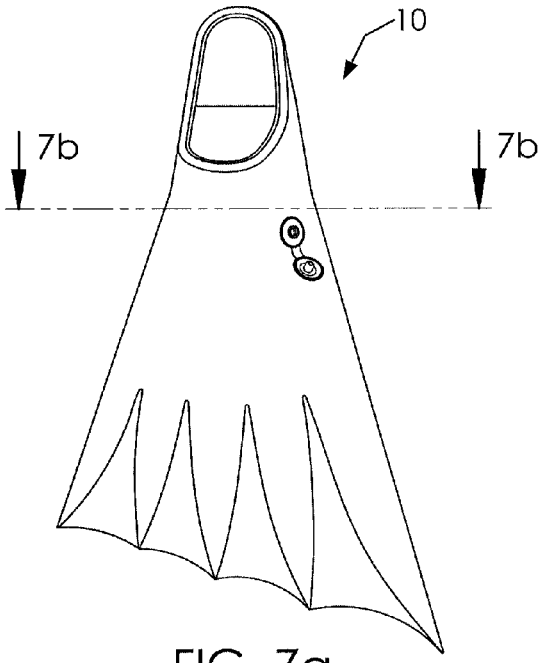
FIG. 7*a* is a top view of the swim fin apparatus as in FIG. 1.
Figure 7B:
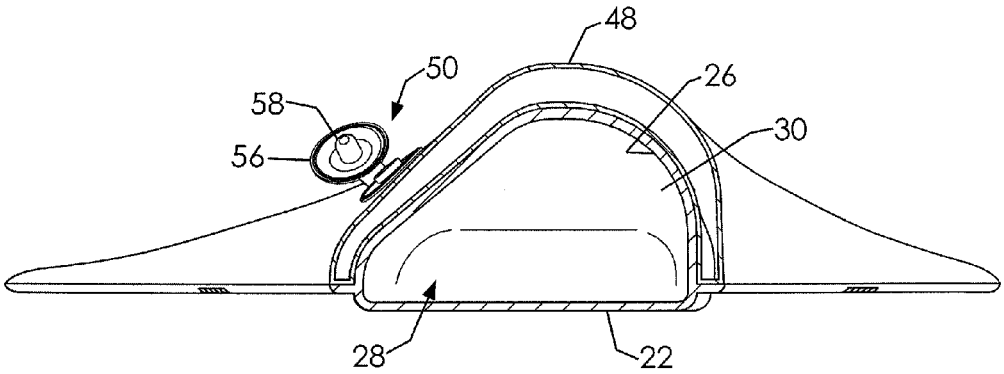
FIG. 7*b* is a sectional view taken along line 7*b*-7*b* of FIG. 7*a*.
Figure 8:
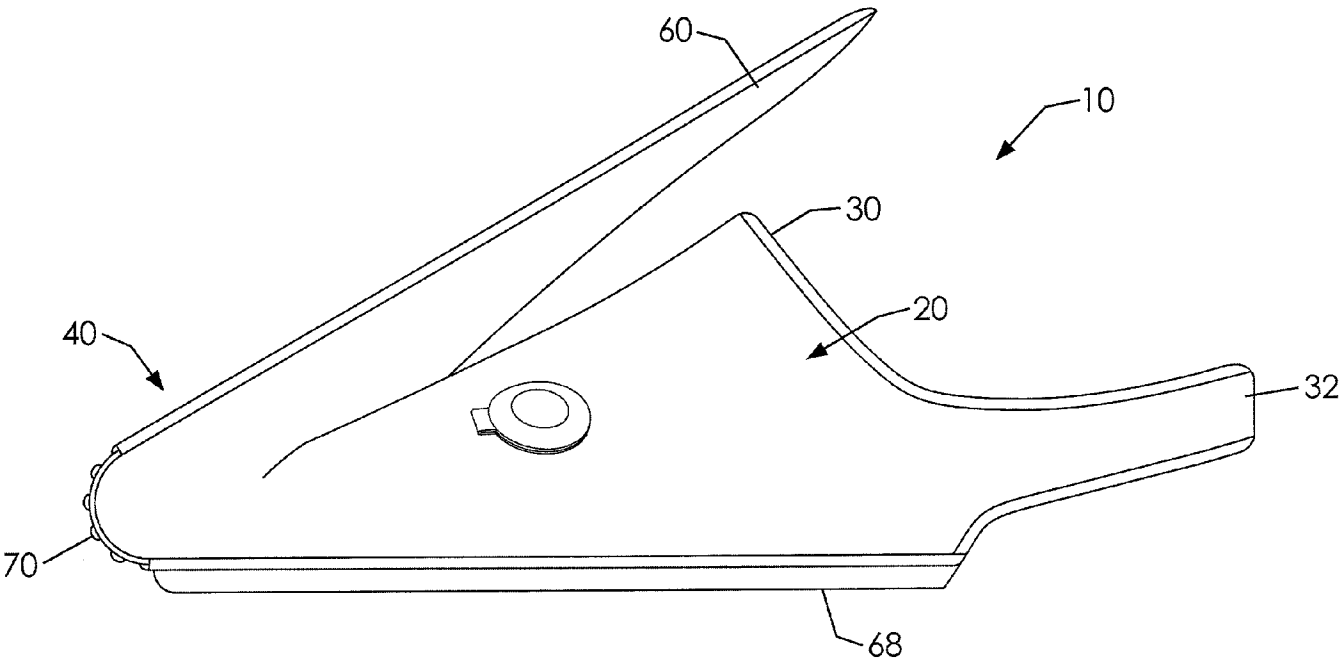
FIG. 8 is a side view of the swim fin apparatus as in FIG. 1 illustrated in a folded configuration.

In one embodiment, the open interior space defined by the fin blade portion 40 may extend along the sides of the foot portion 20, essentially surrounding it (FIG. 7*b*). This may include the bladder 42 being positioned both forwardly of the foot pocket 28 and also beside the foot pocket 28. In one embodiment, even the heel strap 28 may include an air pocket.

In use, the inflatable swim fin apparatus 10 may be stored in the folded configuration (FIG. 8) and then moved to the extended configuration (FIG. 1) for use. Next, the inflation valve 50 may be used to inflate the bladder 42 as described above. A user may slip his foot into the foot pocket 28 and manipulate the heel strap 32 around his ankle. Of course, a second inflatable swim fin apparatus 10 may be utilized for the user's other foot.

It is understood that while certain forms of this invention have been illustrated and described, it is not limited thereto except insofar as such limitations are included in the following claims and allowable functional equivalents thereof.

The invention claimed is:

1. An inflatable swim fin apparatus, comprising:

a foot portion including a lower wall having a peripheral edge and including an upper wall extending upwardly from said peripheral edge of said lower wall, said lower wall and said upper wall defining a foot pocket;

a fin blade portion including an bladder that is inflatable and having a rear wall coupled to said upper wall of said foot portion such that said fin blade portion is positioned forwardly of said foot portion, said bladder defining an interior space configured to hold a volume of air;

wherein said bladder includes a bottom wall and a top wall connected to said rear wall such that said bladder is airtight;

wherein said fin blade portion includes a sole member having a fold line adjacent a front end of said lower wall of said foot portion, said fold line defining an imaginary axis about which said foot portion and said fin blade portion are selectively movable between a folded configuration and an extended configuration.

2. The inflatable swim fin apparatus as in claim 1, comprising an inflation valve positioned on said top wall of said bladder and in communication with said interior space of said bladder, said inflation valve being movable between open configuration allowing air to be inserted into or released from said interior space of said bladder and a closed configuration not allowing air to be inserted or released from said interior space of said bladder.

3. The inflatable swim fin apparatus as in claim 2, wherein said inflation valve includes:

a base coupled to an outer surface of said top wall of said bladder;

a fill port coupled to said base and having a tubular configuration, said fill port being movable between a retracted configuration not allowing air flow with said bladder and an extended configuration allowing air flow with said bladder; and a cap pivotally coupled to said base and movable between open and closed configurations, said cap having a plug that is received in said fill port when said cap is at said closed configuration and is displaced from said fill port when said cap is at said open configuration.

4. The inflatable swim fin apparatus as in claim 1, wherein said fin blade portion includes a plurality of fin blades positioned along a distal end thereof and a plurality of web members intermediate adjacent fin blades, respectively.

5. The inflatable swim fin apparatus as in claim 4, wherein:

said each fin blade includes a generally pointed configuration having an apex at said distal end of said fin blade portion; and each web member includes a generally opposite configuration than said plurality of fin blades.

6. The inflatable swim fin apparatus as in claim 4, wherein said plurality of fin blades and said plurality of web members are constructed of a non-permeable material.

7. The inflatable swim fin apparatus as in claim 1, wherein said lower wall and said upper wall of said foot pocket define a rear opening configured to receive a user's foot into said foot pocket.

8. The inflatable swim fin apparatus as in claim 7, comprising an heel strap extending across said rear opening, so as to encircle an ankle of the user.

9. The inflatable swim fin apparatus as in claim 1, wherein said foot portion and said fin blade portion have a singular construction.

10. An inflatable swim fin apparatus, comprising:

a foot portion including a lower wall having a peripheral edge and including an upper wall extending upwardly from said peripheral edge of said lower wall, said lower wall and said upper wall defining a foot pocket and a rear opening allowing a user's foot to be received into said foot pocket; and a fin blade portion coupled to said upper wall of said foot portion, said fin blade portion including a bladder defining an interior space configured to hold a volume of air.

11. The swim fin apparatus as in claim 10, wherein:

said fin blade potion defines an interior area;

said foot portion and said bladder are positioned in said interior area of said fin blade portion, said bladder being positioned forwardly of said foot pocket and separated therefrom by said upper wall of said foot portion; and said bladder includes a rear wall coupled to said upper wall of said foot portion, said bladder including a bottom wall and a top wall integrally connected to said rear wall such that said bladder is airtight.

12. The inflatable swim fin apparatus as in claim 11, comprising an inflation valve positioned on said top wall of said bladder and in communication with said interior space of said bladder, said inflation valve being movable between open configuration allowing air to be inserted into or released from said interior space of said bladder and a closed configuration not allowing air to be inserted or released from said interior space of said bladder.

13. The inflatable swim fin apparatus as in claim 12, wherein said inflation valve includes:

a base coupled to an outer surface of said top wall of said bladder;

a fill port coupled to said base and having a tubular configuration, said fill port being movable between a retracted configuration not allowing air flow with said bladder and an extended configuration allowing air flow with said bladder; and a cap pivotally coupled to said base and movable between open and closed configurations, said cap having a plug that is received in said fill port when said cap is at said closed configuration and is displaced from said fill port when said cap is at said open configuration.

14. The inflatable swim fin apparatus as in claim 10, wherein said fin blade portion includes a plurality of fin blades positioned along a distal end thereof and a plurality of web members intermediate adjacent fin blades, respectively.

15. The inflatable swim fin apparatus as in claim 14, wherein:

said each fin blade includes a generally pointed configuration having an apex at said distal end of said fin blade portion; and each web member includes a generally opposite configuration than an adjacent fin blade.

16. The inflatable swim fin apparatus as in claim 14, wherein said plurality of fin blades and said plurality of web members are constructed of a non-permeable material.

17. The inflatable swim fin apparatus as in claim 10, wherein said fin blade portion includes a sole member having a fold line adjacent a front end of said lower wall of said foot portion, said fold line defining an imaginary axis about which said foot portion and said fin blade portion are selectively movable between a folded configuration and an extended configuration.

18. The inflatable swim fin apparatus as in claim 10, comprising an heel strap extending across said rear opening, so as to encircle an ankle of the user.

* * * * *